US006698544B2

(12) United States Patent
Kurtgis

(10) Patent No.: US 6,698,544 B2
(45) **Date of Patent: *Mar. 2, 2004**

(54) FALL PROTECTION LANYARD APPARATUS

(76) Inventor: Michael P. Kurtgis, 4101 SW., 47th Ave., Suite 106, Ft. Lauderdale, FL (US) 33314

( * ) Notice: Subject to any disclaimer, the term of this patent is extended or adjusted under 35 U.S.C. 154(b) by 0 days.

This patent is subject to a terminal disclaimer.

(21) Appl. No.: 10/077,266

(22) Filed: Feb. 15, 2002

(65) Prior Publication Data

US 2002/0175025 A1 Nov. 28, 2002

Related U.S. Application Data

(63) Continuation-in-part of application No. 09/865,016, filed on May 24, 2001.

(51) Int. Cl.[7] ..... A47L 3/04

(52) U.S. Cl. ..... 182/3; 182/7; 182/145; 182/150; 244/137.4

(58) Field of Search ..... 182/3, 7, 145, 182/150; 244/137.4, 118.1, 137.1

(56) References Cited

U.S. PATENT DOCUMENTS 4,019,609 A * 4/1977 Wagner ..... 188/65.4
4,426,957 A * 1/1984 Horrigan ..... 119/106
4,502,265 A * 3/1985 Horrigan ..... 54/24
4,612,687 A * 9/1986 Barwood ..... 24/574
4,673,059 A 6/1987 Kurtgis
4,881,672 A * 11/1989 Gustafson ..... 224/264
5,417,304 A 5/1995 Kurtgis
5,494,240 A * 2/1996 Waugh ..... 244/137.4
5,664,843 A * 9/1997 Gleason ..... 297/471
6,164,048 A * 12/2000 Rhodes ..... 54/1
6,205,903 B1 * 3/2001 Woodall et al. ..... 89/1.13
6,279,680 B1 * 8/2001 Casebolt ..... 182/3
6,374,946 B1 * 4/2002 Petzl et al. ..... 182/6
6,457,556 B1 * 10/2002 Skade et al. ..... 182/8

* cited by examiner

*Primary Examiner*—Bruce A. Lev
(74) *Attorney, Agent, or Firm*—Mark D. Bowen, Esq.; Stearns Weaver Miller Weissler Alhadeff & Sitterson, P.A.

(57) ABSTRACT

A fall protection lanyard apparatus incorporating an automatic emergency release is disclosed. Competing concerns of fall protection (for the load) and on-demand emergency release (for the aerial lift) are each enabled by providing the first lanyard with a quick release mechanism and the second lanyard with a release triggering mechanism. The lanyard apparatus is adapted for attachment to a human or non-human load. The first lanyard incorporates a quick-release mechanism, which, upon activation, results in the separation of the connectable end portion thereof. The second lanyard incorporates a mechanism for activating the quick-release upon application of a predetermined force thereon. The lanyard apparatus provides total fall protection during the transfer of a load to a structure in any elevated environment while providing an on-demand quick-release in emergency situations.

9 Claims, 7 Drawing Sheets

FALL PROTECTION LANYARD APPARATUS

CROSS REFERENCE TO RELATED APPLICATIONS

This application is a continuation-in-part of U.S. patent application Ser. No. 09/865,016, filed May 24, 2001.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

The present invention relates generally to safety devices used in fall protection, and, more particularly, to lanyard apparatus for use in providing fall protection for a load in an elevated environment.

2. Description of the Background Art

There are a number of basic devices, such as safety harnesses, for use in providing fall protection for loads in elevated environments, such as loads in connection with human external load operations ("HEL"). Safety harnesses, for example, commonly consist of shoulder straps attached to a waist or chest belt. Some harnesses incorporate suspender-style straps with a tether point-of-attachment on the front center of the chest/waist strap. Others comprise a Y-shaped design, where the shoulder straps are connected to a strap extending vertically from the waist belt to form a three-point intersection. These harnesses are typically constructed of nylon webbing, and commonly include padding. The harness is designed to support the load (i.e., body weight) by the torso and shoulders of the user for suspension from a helicopter. Sit harnesses comprise another category of HEL devices. Also known as pelvic harnesses, bosun's seat, rescue harnesses, or rigger's harnesses, these devices suspend the user in a seated posture. The basic design of a sit harness includes a waist belt connected to leg loops routed around the top of the thighs. The point of the tether attachment typically extends directly in front of the upper pelvic region. Full-body harnesses ("FBH") comprise a combination of sit harnesses and chest harnesses. While there are a number of variations of the basic design of the harness, all full-body harnesses include leg loops, shoulder straps, and either a waist belt, a chest belt, or both.

One application wherein such safety devices are used involves the use of rotary winged aircraft, such as helicopters, in external load transfer operations. For example, human external load operations typically involve the transportation of a passenger suspended by a cable assembly under a helicopter. For example, helicopters equipped with load suspension points, or hooks, are commonly used to transport loads in a sling configuration wherein the load is suspended beneath the helicopter by a suspension apparatus. In other applications, helicopters carry cargo as well as human loads in various configurations external to the fuselage, such as on the skids or on skid-mounted platforms. For example, load-bearing platforms may be affixed to the helicopter to permit persons to operate external to the crew compartment. In other situations, a person may stand on one of the helicopter landing skids and operate in the external environment. HEL operations are commonly performed in transmission line maintenance and repair procedures in the electrical power industry, in the logging industry to access remote work sites, and for emergency rescue operations.

The present inventor has contributed significantly to safety advances in helicopter external load operations, particularly external human load operations. My U.S. Pat. No. 4,673,059 discloses a method and system for placing a load, which may consist of a combination of personnel and equipment, on or in proximity to components of an energized power transmission line. My U.S. Pat. No. 5,417,304 discloses a method for suspending a load from a rotary winged aircraft, such as a helicopter, using an apparatus that incorporates an emergency release capable of being activated by the suspended person.

In certain situations, however, it is necessary or desirable to transfer external loads from a hovering helicopter to a structure, such as a power transmission tower or an energized or de-energized power transmission line, ground wire, or other elevated point or structure. Neither the methods disclosed in my '059 and '034 patents, nor the background art, discloses a suitable safety apparatus for accomplishing the transfer of an external load from a hovering helicopter to an elevated structure while maintaining adequate safeguards for both the helicopter as well as the load.

While my '304 patent discloses an emergency release for use with a suspended load, the system disclosed therein is a release-on-command type system that requires the suspended person to: (1) realize the existence of an emergency effecting the helicopter; and (2) manually activate the quick release to permit the helicopter to pull away. If the suspended person fails to either realize an emergency situation requiring emergency release, or fails to activate the quick release that system will not adequately protect both the person and the helicopter. Thus, the primary concerns in such external load transfer applications involve maintaining adequate fall protection for the person or load during the transfer procedure without limiting helicopter operations, particularly the ability of the helicopter to execute emergency maneuvers and operations. It is critical to maintain full fall protection for the person or load through the entire transfer process, while at the same not limiting the operation of the helicopter in emergency situations.

Currently, there is little standardization and a general lack of safety procedures practiced by those performing HEL operations. While regulations exist regarding the physical and structural characteristics of external load operations, little consideration has been given to the issue of humans as external loads. Federal Aviation Regulations applicable to rotorcraft operations, particularly those referring to human external loads, are found in Title 14 of the Code of Federal Regulations (CFR). The collection of FAA regulations found in 14 CFR is often referred to as the Federal Aviation Regulations (FARs). Within 14 CFR, part 133 pertains directly to rotorcraft external load operations and contains subparts that address applicability, certification rules, operating rules, and related requirements. In addition, part 27 requires that any external load attaching means must include a quick-release system to enable the pilot to release the external load quickly during flight. While the regulations address a number of areas, they provide no specific detail regarding the attachment method, human load transfer methods, or the structure or function of quick-release devices.

As a result of the lack of adequate safety methods there have been a number of rotorcraft accidents in connection with HEL operations. During the period from 1973 through 1995, it has been reported that there were 473 external load operations in which the helicopters were involved in either an accident or an incident. Of the 473 accidents listed, a substantial number involved operations using a sling line or sling load. Accordingly, it is recognized that the predominant cause of external load accidents involves problems with the sling line/load.

One common, yet inherently risky prior art method of transferring an external human load from a hovering helicopter to a structure, in a non-sling configuration, consists of bringing the helicopter to a hover immediately adjacent to a structure, wherein the helicopter may be stabilized by the placement of one or both skids (or wheels) on the structure for a period of time thereby allowing the person to step from the helicopter to the structure. This method, however, is significantly flawed in that, to avoid tethering the helicopter to the structure and thereby limiting the availability of emergency flight procedures (e.g. emergency pull-away), there exist periods of time during the transfer that the person is without fall protection, and consequently at substantial risk. For example, a person transferring from a helicopter to a tower typically detaches a safety lanyard from a secure point on the helicopter and attaches the safety lanyard to the tower during the transfer process. Thus, there exists a period of time, between detachment and re-attachment, that the person is without fall protection. If, during this time period, the helicopter executes an emergency pull-away maneuver, the person is at substantial risk of falling.

Thus, although HEL operations have been practiced, there remains a need a safety lanyard apparatus for use in providing fall protection for loads in an external environment. More particularly there exists a need for an improved safety lanyard for use in external load operations that is adapted to provide total fall protection for the load while preserving emergency operating procedures for the helicopter by incorporating an automatically activating emergency quick release.

BRIEF SUMMARY OF THE INVENTION

The present invention addresses the shortcomings of the background art by providing a fall protection lanyard apparatus for use in transferring loads in an elevated environment. The fall protection lanyard may be connected to a load and used to transfer the load from an airborne rotorcraft to a structure while providing fall protection and automatic emergency release capabilities to enable the rotorcraft to freely execute emergency maneuvers. A significant aspect of the invention relates to a lanyard apparatus that provides total fall protection for the load throughout the transfer process without restricting or otherwise limiting available emergency flight options/maneuvers by incorporating an emergency release that automatically activates on demand.

In a preferred embodiment, the fall protection lanyard apparatus includes first and second load-bearing lanyards, each terminating in a free end incorporating a hook or carabiner. The competing concerns of fall protection (for the load) and on-demand emergency release (for the aircraft) are each enabled by providing a quick release mechanism activated by a predetermined tension force, such as the force that would be experience if the first and second lanyards were simultaneously connected to the helicopter and a rigid structure and the helicopter executed an emergency pull-away thereby placing tension on the lanyard apparatus.

Each lanyard is preferably attached to a common point, such as a load bearing steel O-ring, which in turn is attached to a safety harness which secures the load. In one embodiment: the first lanyard incorporates a quick-release mechanism, which, upon activation, results in the separation of the hook end portion thereof; and the second lanyard incorporates a limited slip mechanism, which, upon application of a predetermined force thereon, activates the first lanyard's quick-release mechanism. In an alternate embodiment, a mechanical fitting, such as a rivet, or break-away link or member is configured to bear the tension force and is selected to fail upon experiencing a predetermined force (e.g. 100 lbs.) thereby activating the quick release mechanism. The lanyard apparatus disclosed provides total fall protection during the transfer of a load to a structure in any elevated environment while providing an on-demand quick-release in emergency situations.

The lanyard apparatus may be used to transfer a load from the hovering aircraft to an adjacent structure by: (1) attaching the free end of the first lanyard to the helicopter; (2) attaching the free end of the second lanyard to the structure; (3) detaching the first lanyard from the helicopter; and (4) depositing the load onto the structure. When transferring from the structure to the helicopter the method is essentially reversed. When transferring loads as described, fall protection is provided since the load is safely tethered to a load bearing structure at all times, e.g. helicopter or structure. In addition, the quick release mechanism may be used to simultaneously provide an emergency release that allows the helicopter to instantly pull away without placing the external load at risk.

Accordingly, it is a primary object of the instant invention to provide an improved fall protection apparatus.

Another object of the present invention is to provide a fall protection apparatus adapted to provide comprehensive fall protection for a person or thing in an elevated environment.

Still another object of the present invention is to provide a safety apparatus that provides fall protection for a human external load engaged in an airborne transfer, before, during, and after transfer to a structure.

Yet another object of the present invention is to provide a fall protection system for HEL operations that provides an emergency release for a helicopter tethered to a structure while transferring human and non-human loads to or from the structure.

Still another object of the present invention is to provide a fall protection system for HEL operations that automatically releases a tethered helicopter in an emergency pull-away situation while transferring a load to or from the structure, while leaving the load securely tethered to the structure.

Another object of the present invention is to provide an apparatus for use in transferring loads from a hovering rotorcraft to a structure while providing total fall protection and incorporating an emergency release that does not require activation by the person being transferred.

In accordance with these and other objects, which will become apparent hereinafter, the instant invention will now be described with particular reference to the accompanying drawings.

DETAILED DESCRIPTION OF THE INVENTION

With reference now to the drawings, there is illustrated a preferred embodiment of an emergency release lanyard apparatus according to the present invention for use in transferring a load in an elevated environment, for example, such as from a hovering helicopter to an elevated location on a structure. FIGS. 1 through 7B illustrate a fall protection lanyard, generally referenced as 10. Lanyard apparatus 10 includes connected first and second lanyards, referenced as 12 and 14 respectively. In a preferred embodiment, lanyards 12 and 14 are connected to a common load-bearing ring 16. Ring 16 further provides a connection point for attachment of lanyard apparatus 10 to a safety harness (not shown) secured to a load via a safety hook 17 or other equivalent mechanical connecting device. By way of example, the safety harness may be a personal safety harness worn by a human load, or a cargo harness attached to a non-human load.

Figure 1:
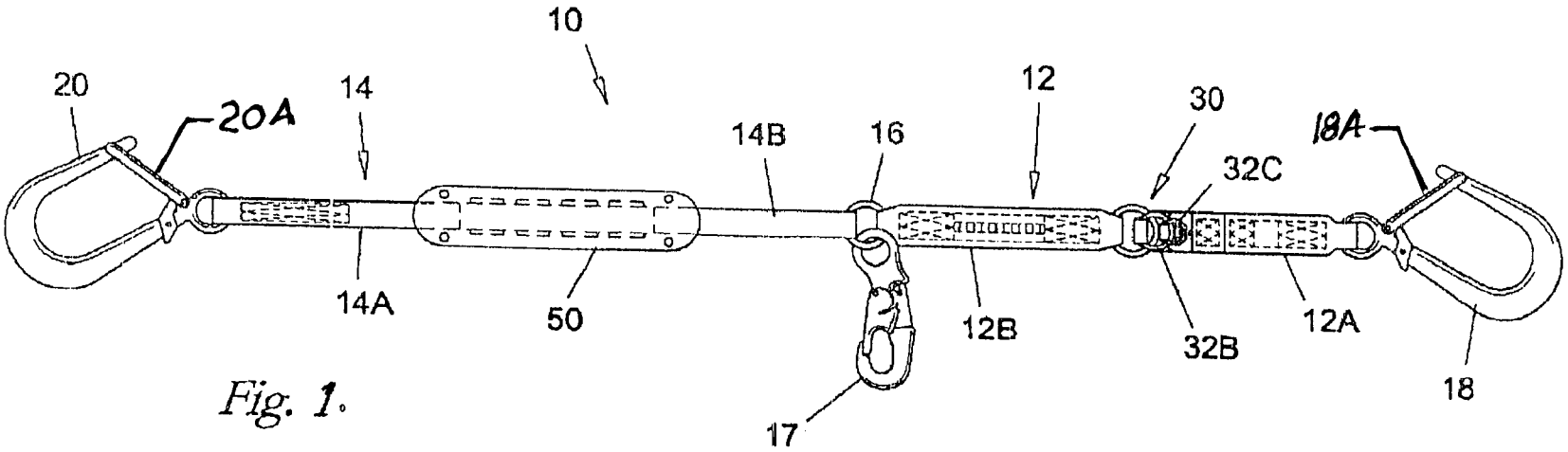
FIG. 1 depicts a top view of an emergency release lanyard apparatus according to the present invention.
Figure 2:
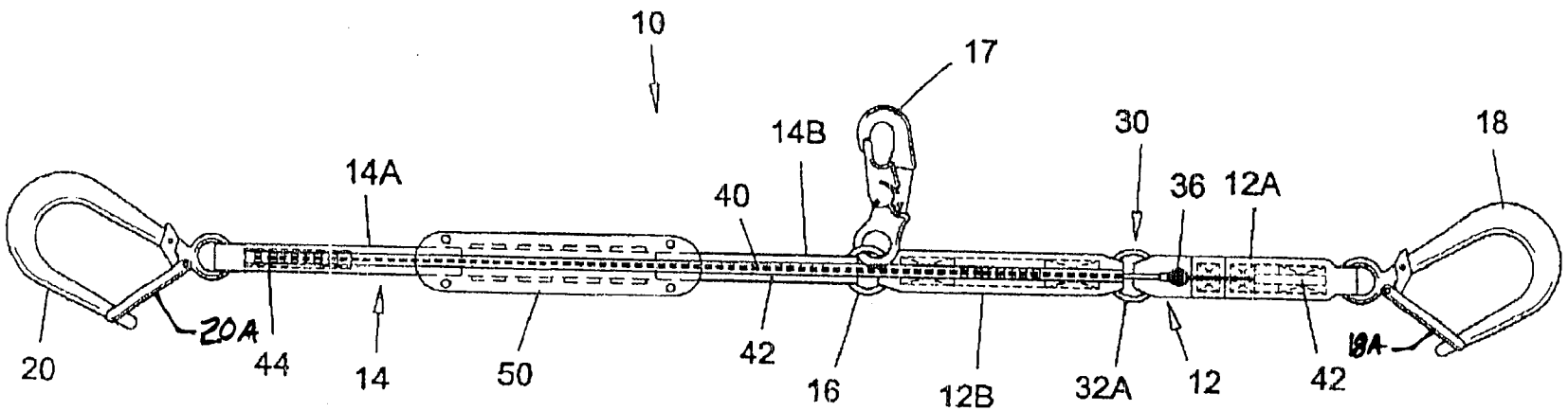
FIG. 2 depicts a bottom view thereof.
Figure 3:
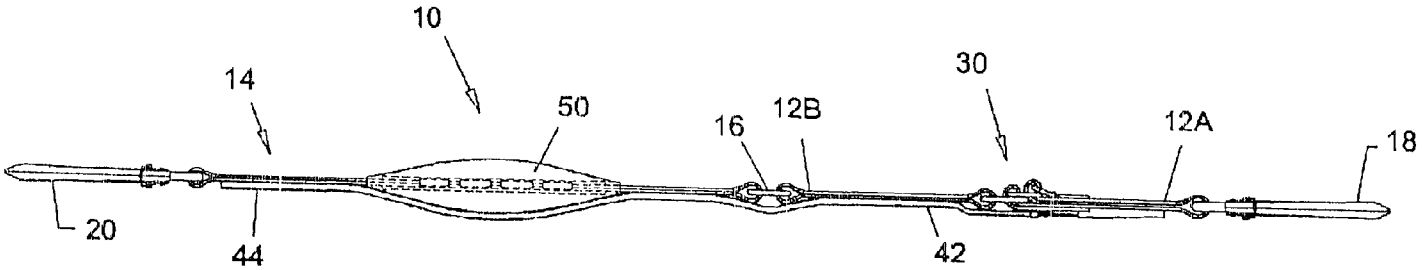
FIG. 3 depicts a side view thereof.
Figure 4:
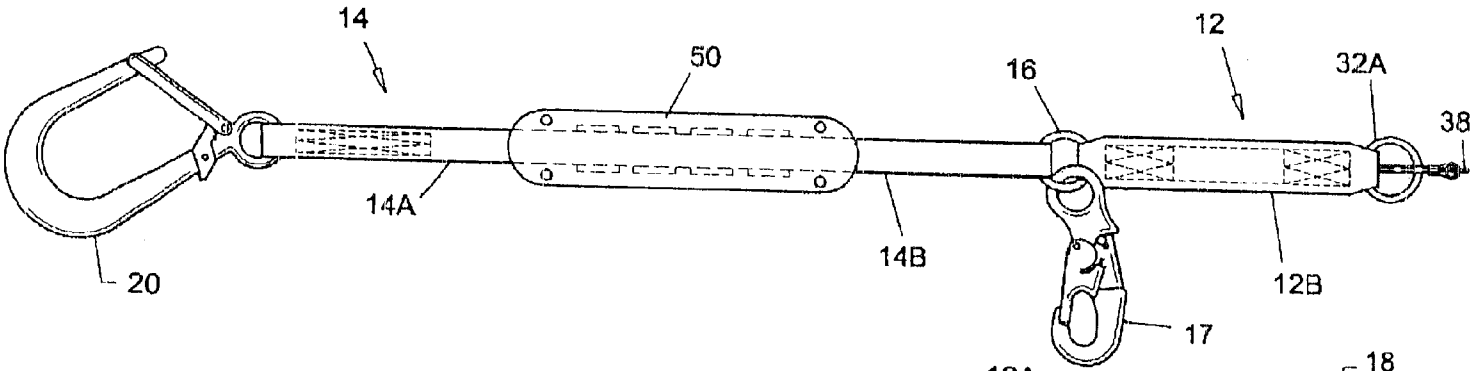
FIG. 4 depicts a top view thereof wherein the lanyard end portion is disconnected from the remaining portion of the apparatus illustrating separation in an emergency release situation.
Figure 4:
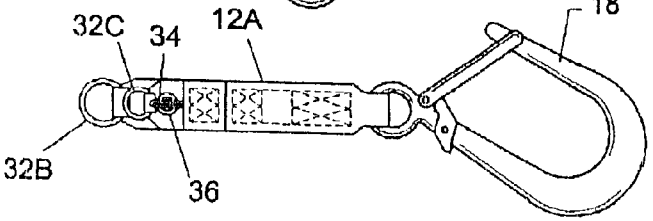

Lanyards 12 and 14 may be fabricated from any suitable, flexible load bearing material, such as nylon straps, rope, cable, or equivalent, preferably flexible, load bearing member. Lanyards 12 and 14 each terminate in a free end fitted with a safety hook. As best depicted in FIGS. 1 and 2, safety hooks 18 and 20 are connected at or proximal to the lanyard ends, and are preferably locking type hooks, such as ladder hooks or snap hooks, having a pivoting gate, referenced as 18A and 20A, with a double-action locking feature. The double-action locking mechanism is a safety feature that requires two separate and distinct manual acts/movements to open the gate and undo the hook thereby preventing the undesired or unintentional attachment/detachment of the hook. Hooks 18 and 20 are used to selectively attach the lanyard and load to points on a helicopter or structure during the transfer process as more fully disclosed herein. It should be noted, however, that the present invention contemplates that any suitable alternate means for connecting, including carabiners, locking carabiners, or clamps may be substituted for hooks 18 and 20.

Figure 5A:
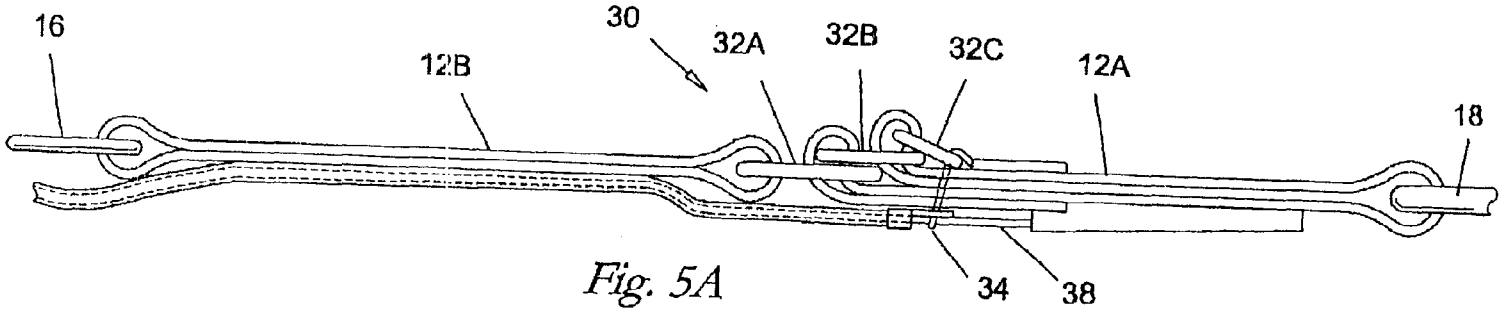
FIG. 5A is side detail view of a preferred embodiment emergency release mechanism for the lanyard apparatus in a connected configuration.
Figure 5B:
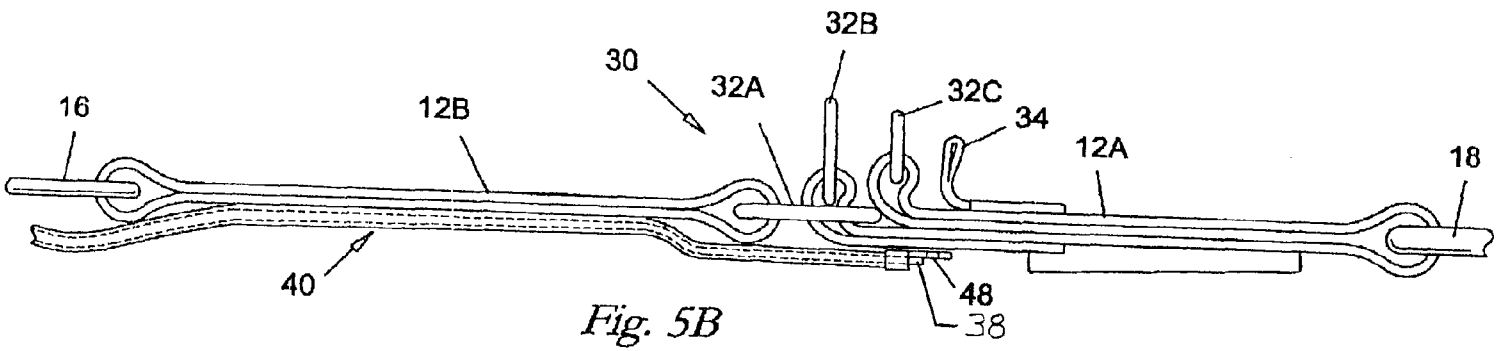
FIG. 5B is another side detail view thereof in a partially released configuration.
Figure 5C:
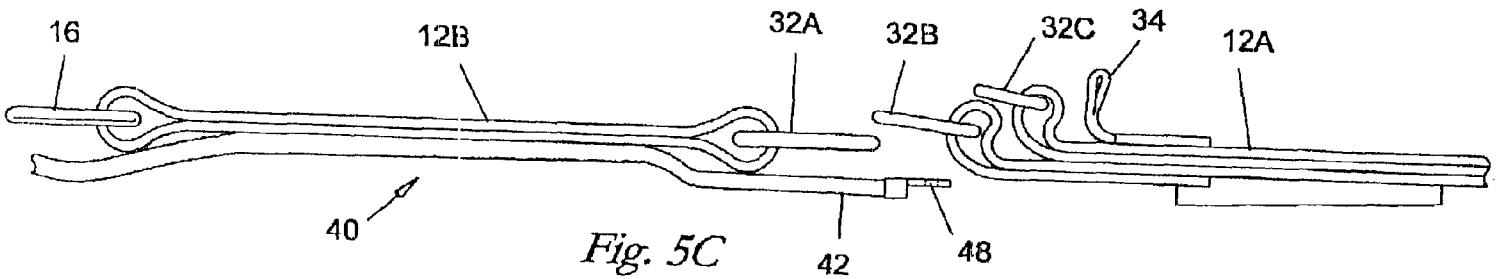
FIG. 5C is another side detail view thereof in a fully released configuration.
Figure 6A:
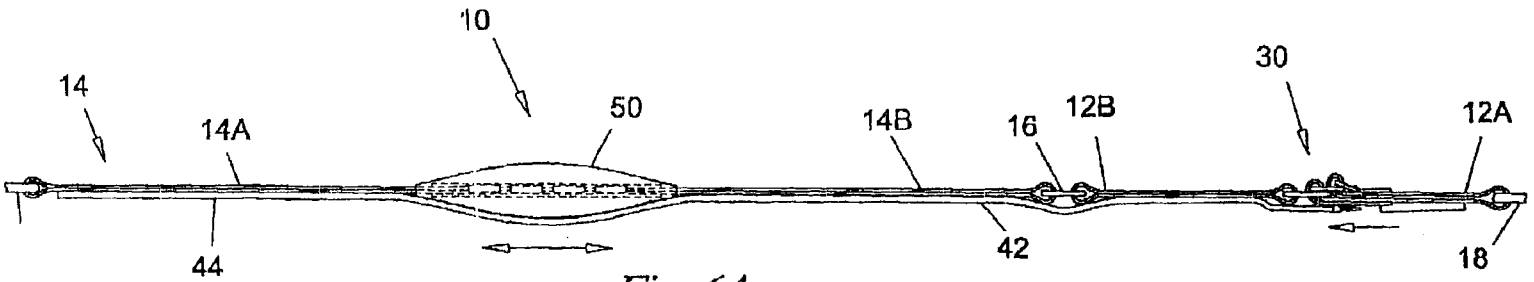
FIG. 6A is a partial side view of the lanyard apparatus illustrating activation of the emergency release mechanism by deployment of the limited slip mechanism.
Figure 6B:
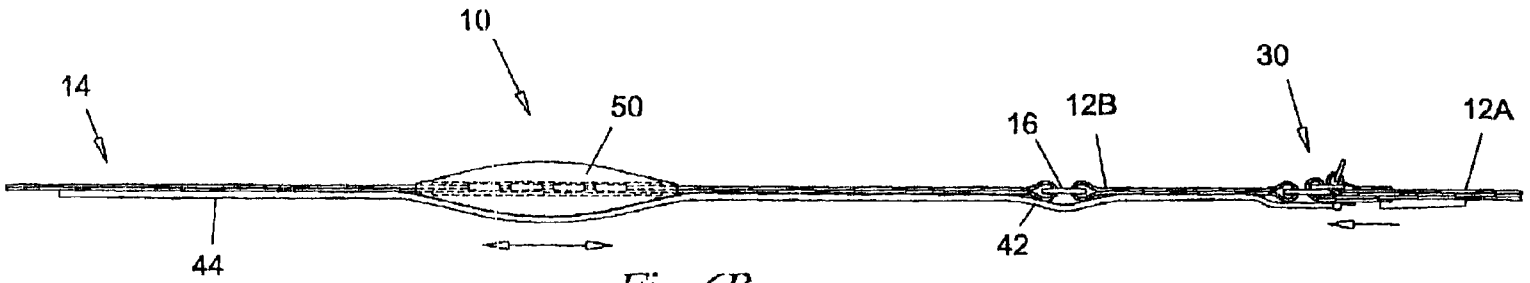
FIG. 6B is a partial side view thereof further illustrating activation of the emergency release mechanism.
Figure 5D:
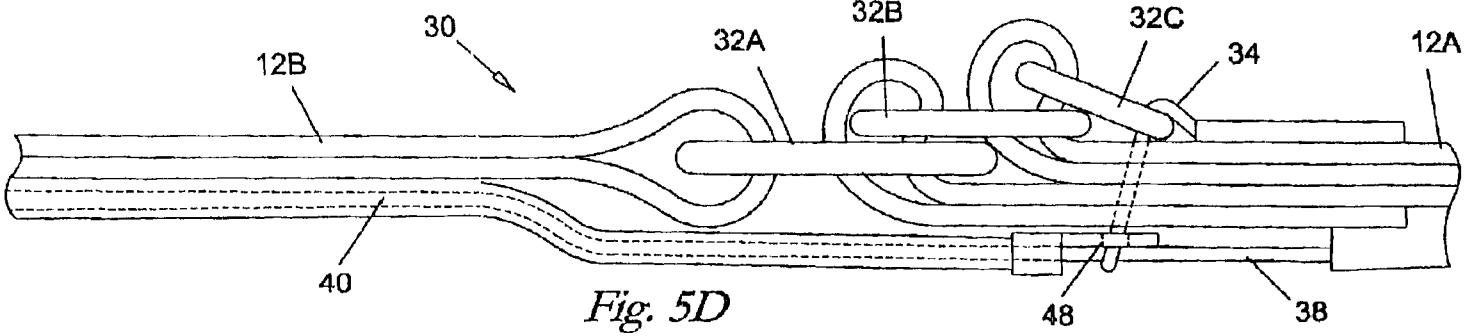
FIG. 5D is a detail view of the connecting mechanism shown in FIG. 5A.

With reference now to FIGS. 1 through 4, attention is drawn to a quick release assembly, generally referenced as 30. More particularly, lanyard 12 incorporates a quick release mechanism 30 that is adapted for activation by a predetermined threshold force applied to the lanyard apparatus. Upon activation of the quick release mechanism the end portion of lanyard 12, generally referenced as segment 12A, is released from the remaining portion of the lanyard apparatus, and particularly released from lanyard segment 12, which remaining portion is generally referenced as segment 12B. Quick release mechanism 30 includes a releasable connection joining lanyard segments 12A and 12B. As best depicted in FIGS. 5A, 5B, and 5C, quick release mechanism 30 preferably includes an interlocked series of rings, referenced as 32A, 32B and 32C, secured in an interlocked load-bearing configuration, joining lanyard segments 12A and 12B. The interlocked rings are secured in a load-bearing configuration by a loop formed by parachute cord 34 having one end thereof attached to one side of lanyard segment 12A, a mid-portion disposed through ring 32C and metal grommet 36, best seen in FIG. 2, in lanyard segment 12A. As best seen in FIG. 5A, loop 34 is secured by a pin 38 removably inserted therethrough such that loop 34 secures rings 32A–C in a securely interlocked configuration capable of withstanding substantial loads. As best depicted in FIGS. 5A–5C and 6A and 6B, retracted removal of pin 38 from loop 34 enables disconnection of lanyard segment 12A from segment 12B. More particularly, pin 38 is connected to a first end of a cable 40, which is preferably slidably received within a conduit 42 terminating in an eyelet 48, secured to lanyard segment 12B. Cable 40 includes a second end 44 that is connected to lanyard segment 14, and particularly end segment 14A. Movement of cable 40 causes the cable to retract relative to conduit 42 and loop 34 thereby displacing pin 38 from loop 34 and allowing separation of lanyard segment 12A from segment 12B by disengagement of rings 32A–C.

In the embodiment depicted in FIGS. 1–4 and 6A and 6B, lanyard 14 includes an end portion 14A that is connected to the remaining portion of lanyard 14, referenced as 14B, via a limited slip/shock absorbing mechanism, generally referenced as 50. Limited slip mechanism 50 allows for limited extension of lanyard 14 upon application of a predetermined force (e.g. 500 lbs.). In a preferred embodiment, the limited slip mechanism comprises a shock-absorbing lanyard, such as is available from Descent Control, Inc. of Fort Smith Ariz. and/or Miller Fall Protection Products, Inc. of Franklin, Pa. The present invention, however, contemplates use of any suitable limited slip mechanism and/or mechanism that provides for the lanyard extension in response to a predetermined threshold force. Upon application of a sufficient force, such as the force that would be encountered if the rotorcraft attempts to pull away in an emergency situation when tethered to the structure (e.g. hook 18 attached to helicopter and hook 20 attached to structure), the limited slip mechanism would activate thereby allowing the length of lanyard 14 to extend. In a preferred embodiment, a force in excess of 500 lbs. is required to activate the limited slip mechanism whereby an additional length of lanyard is deployed, however, lesser threshold forces may be desirable in other applications. As illustrated in FIGS. 5A–5C, extension of lanyard 14 causes activation of the quick release mechanism on lanyard 12 as described hereinabove by retraction of pin 38 into cable 42 thereby releasing looped cord 34. Once released, the tension on the lanyards causes looped cord 34 to pull through eyelet 48 and ring 32C thereby activating the quick release by allowing separation of rings 32 from the interlinked configuration.

Figure 7A:
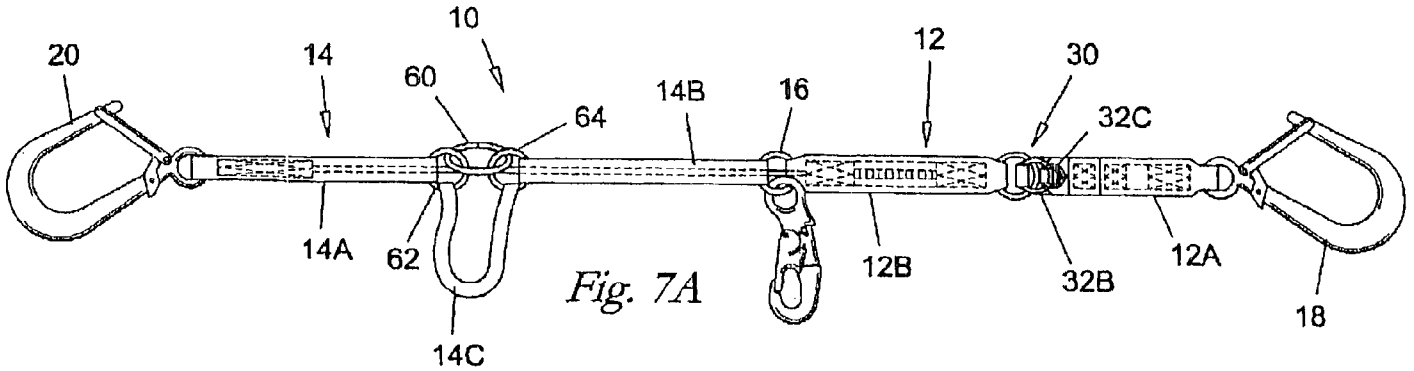
FIG. 7A is an alternate embodiment lanyard apparatus in a connected configuration with a breakaway link.
Figure 7B:
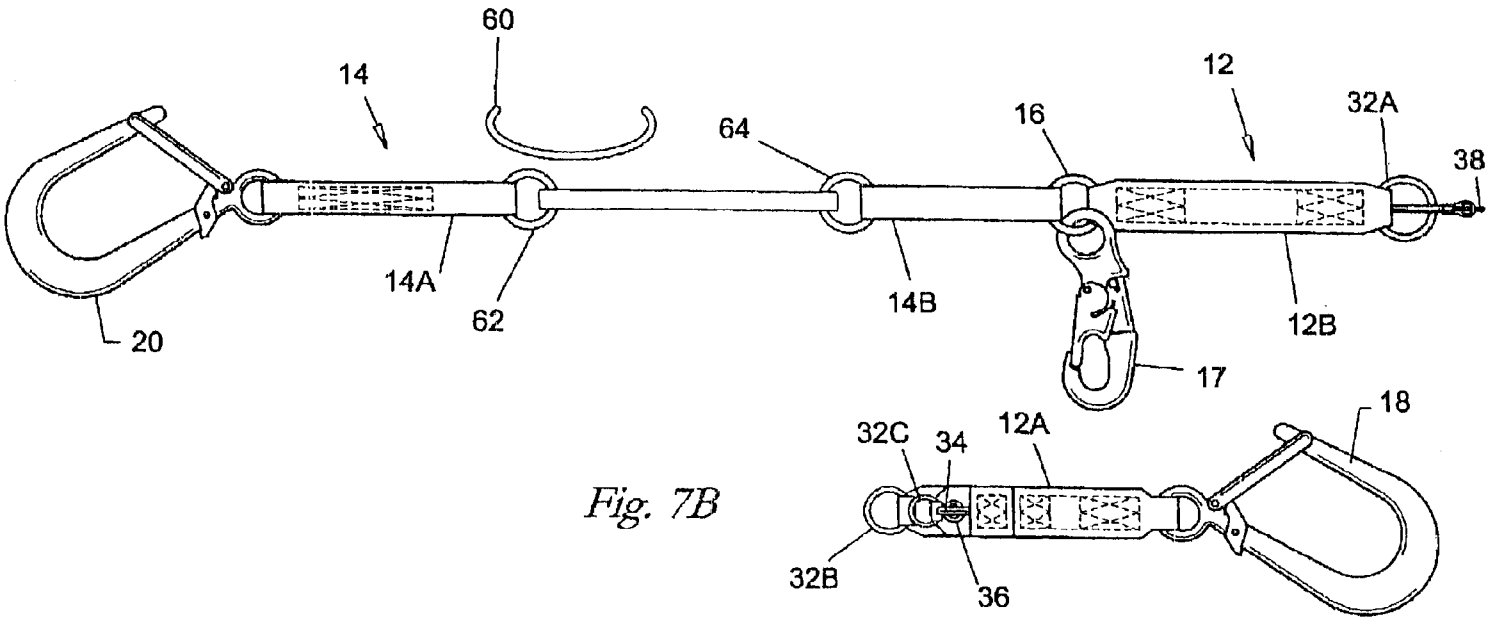
FIG. 7B is view thereof in a disconnected configuration.

In the alternate embodiment depicted in FIGS. 7A and 7B, the limited slip mechanism may comprise a breakaway link 60 in combination with a third lanyard segment 14C joining lanyard segments 14A and 14B. In this embodiment, the breakaway link 60 joins segments 14A and 14B in close proximity by linked connection with additional rings 62 and 64 attached to the respective end portions of lanyard segments 14A and 14B. In addition, lanyard segment 14C has opposing ends connected to ring 62 and 64 respectively. Breakaway link 60 is selected such that application of a predetermined threshold force thereto results in separation of the link and extension of lanyard 14 by the length of segment 14C. It should be noted, that any other suitable mechanism that allows for limited extension of lanyard 14 in response to the application of a force of a predetermined threshold value is considered within the scope of the present invention.

As previously noted, the second cable end 44 is connected to lanyard segment 14A. Accordingly, when a predetermined opposing force is applied to hooks 18 and 20, the limited slip mechanism 50 (or alternatively breakaway link 60) activates thereby allowing lanyard 14 to extend. Extension of lanyard 14 causes cable 40 to slide within conduit 42 thereby removing pin 38 from loop 34. Once free, loop 34 no longer functions to maintain the connection between lanyard segments 12A and 12B thereby allowing the separation of lanyard section 12A from the remaining portions of the device 10. It should also be noted that the means for activating release 30, e.g. limited slip mechanism 50 or breakaway link 60, or an alternate means for activating release 30, may in an alternate embodiment, be incorporated on lanyard segment 12, and particularly on segment 12B, rather than on lanyard segment 14.

Figure 8A:
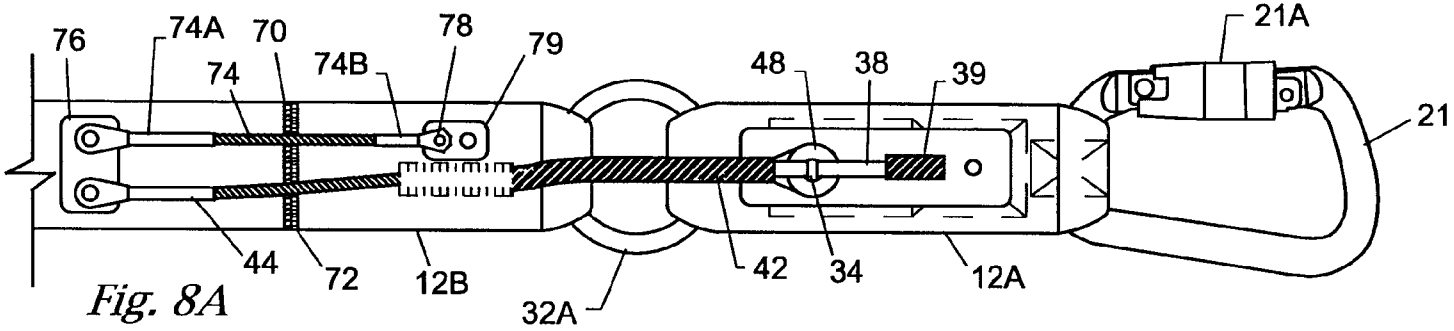
FIG. 8A is a partial bottom view of an alternate embodiment configuration incorporating a frangible link.
Figure 8B:
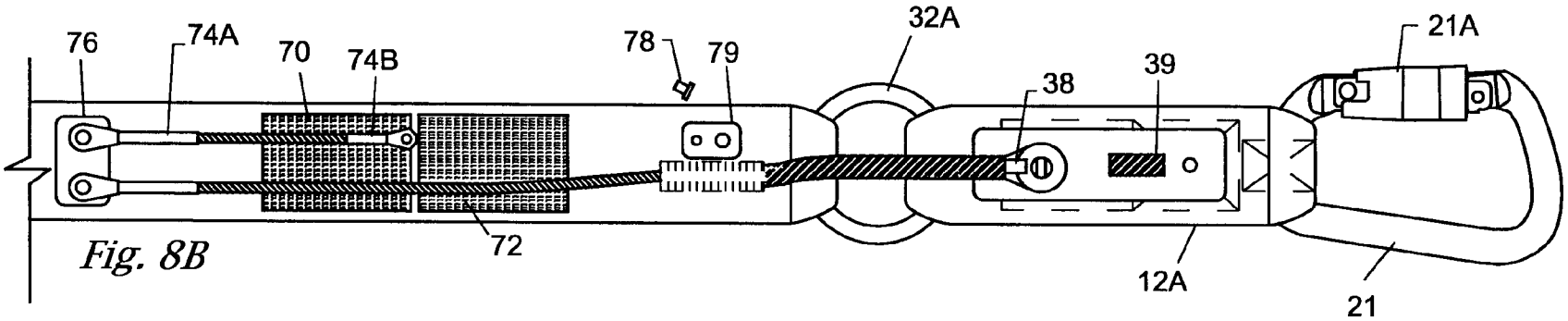
FIG. 8B is a view thereof were the frangible link has failed.

FIGS. 8A and 8B depict yet another embodiment wherein locking carabiners, referenced as 21, are used in lieu of hooks. A locking carabiner includes an additional mechanism that makes it harder for the gate to open accidentally. Typically the additional mechanism is a sheath or sleeve, referenced as 21A, that covers the gate and the outer C-shaped portion of the carabiner. The sheath either screws into place, or uses a spring to hold it in place. To open the gate, the sleeve must be moved from a first position to a second position wherein the gate may be opened.

In the embodiment depicted in FIGS. 8A and 8B, the quick release mechanism 30 again comprises the interlinked ring configuration wherein rings 32A, 32B, and 32C maintained in a load-bearing interlocked configuration by loop 34 secured by pin 38 as disclosed hereinabove. As seen in FIG. 8A, a sleeve 39 is attached to lanyard segment 12A to receive the end of pin 38 to prevent unintentional snagging. In this embodiment, however, lanyard segment 12B includes a portion having hook and loop fastening material, comprising a hook patch 70 and a loop patch 72, affixed thereto. The hook and loop fastening material allows for the folded connection of lanyard 12B as depicted in FIG. 8A in a shortened/retracted configuration. Lanyard 12B is maintained in the folded configuration by a cable 74 secured at one end thereof, referenced as 74A, to a portion of lanyard 12B by a load bearing rivet and plate assembly, referenced as 76, and secured at the opposing end thereof, referenced as 74B by a break-away rivet 78 secured by a rigid plate 79 forming a frangible link. In this embodiment, lanyard segment 12B is maintained in the shortened configuration by cable 74. The quick release is automatically triggered when a predetermined threshold force applied to lanyard 12 is reached and break-away rivet 78 fails thereby releasing cable end 74B whereby the tension causes lanyard 12B to lengthen pulling apart hook patch 70 from loop patch 72, as best seen in FIG. 8B, resulting in a lengthening of lanyard segment 12B. The lengthening of lanyard segment 12B causes cable 40 to retract pin 38 from loop 34 thereby activating the quick release of rings 32A–32C resulting in the detachable release of lanyard segment 12A as described hereinabove.

Figure 9A:
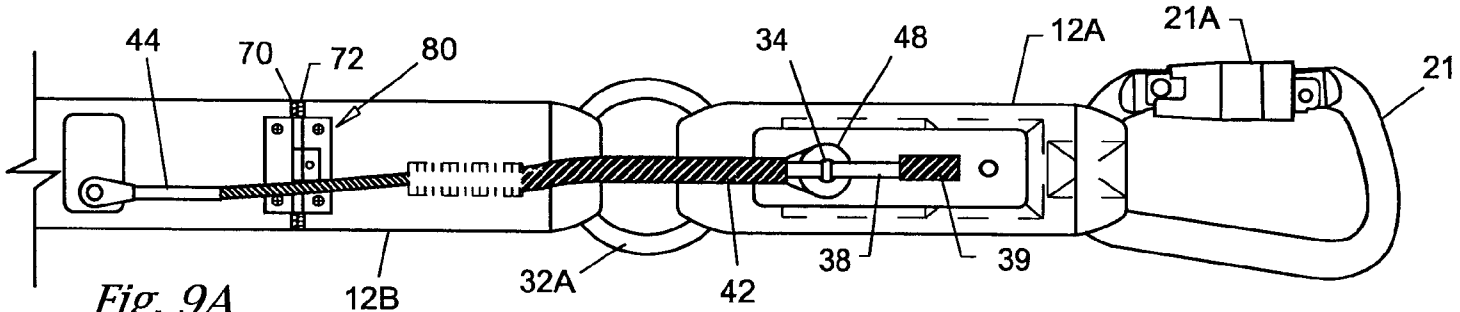
FIG. 9A is a partial bottom view of an alternate embodiment configuration wherein the frangible link is embodied in a hinge.
Figure 9B:
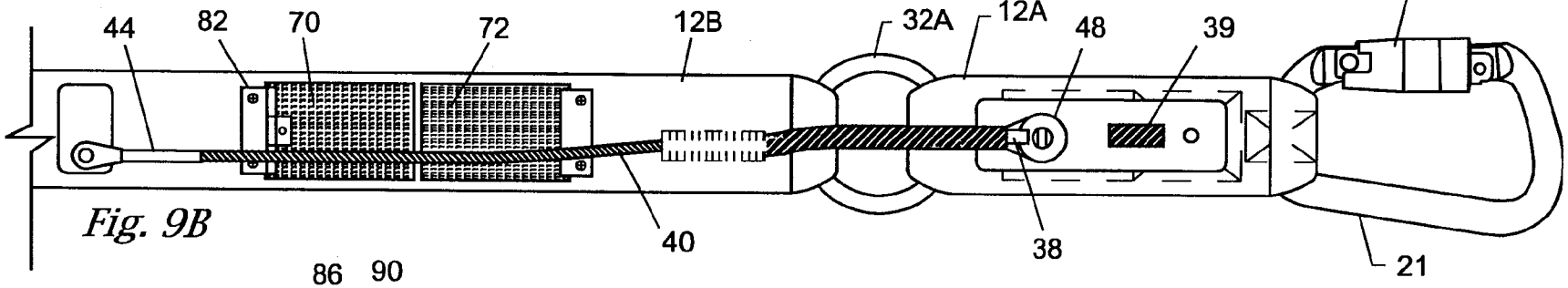
FIG. 9B is a view thereof where the frangible link has failed.
Figure 9C:
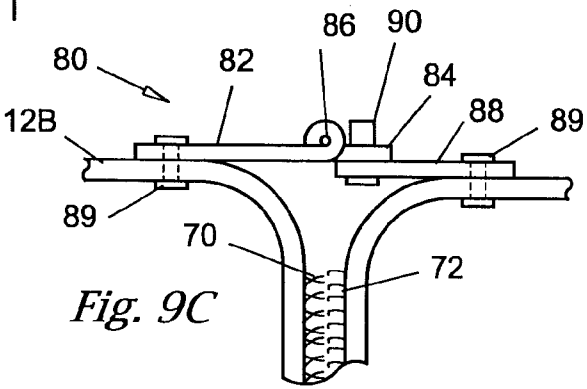
FIG. 9C is a side detail view of the frangible link.

In yet another alternate embodiment depicted in FIGS. 9A–9C, lanyard segment 12B is maintained in the shortened configuration by a hinged plate assembly, generally referenced as 80, which forms the frangible link. Hinged plate assembly 80 includes a first hinge leaf 82 pivotally connected to a second hinge leaf 84 by a pivot pin 86. First hinge leaf 82 is securely connected to lanyard 12 by a strong connection, such as by riveting with one or more rivets 89. Second hinge leaf 84 is connected to a plate 88, which in turn is connected to lanyard segment 12A by a strong riveted connection 89 as best seen in FIG. 9C. A rivet 90 connects hinge leaf 84 to plate 88. Rivet 90 is specifically selected to fail when a predetermined threshold force is applied to lanyard 12, and particularly to hinge assembly 80. Upon the failure of rivet 90, hinge leaf 84 is released thereby allowing the lengthening of lanyard segment 12B as depicted in FIG. 9B. The lengthening of lanyard segment 12B causes cable 40 to retract pin 38 from loop 34 thereby activating the quick release of rings 32A–32C resulting in the detachable release of lanyard segment 12A as described hereinabove.

The emergency release lanyard apparatus disclosed herein may be used to safely transfer a load in an elevated environment. For example, loads may be transferred from a first elevated platform, such as an airborne rotorcraft, to an adjacent elevated platform or structure while providing fall protection for the load and emergency release capabilities. Use of the fall protection lanyard 10 in an elevated environment requires secured attachment of the apparatus to the load and/or to a safety harness attached to the load, and safe transfer is accomplished by: (1) attaching the free end of lanyard 12 to the first elevated platform by attachment of hook 18; (2) releasing any auxiliary safety restraints; (3) attaching the free end of lanyard 14 to the second elevated platform by attachment of hook 20; (4) detaching lanyard 12 from the first elevated platform; and (5) depositing the load onto the second elevated platform. When transferring from the second elevated platform (e.g. tower) to the first elevated platform (e.g. helicopter) the method is essentially reversed.

The competing concerns of fall protection (for the load) and on-demand emergency release (for the aircraft) in HEL operations are each enabled by the emergency release lanyard 10. The lanyard apparatus provides total fall protection for the load throughout the transfer process without restricting or otherwise limiting available emergency flight options/maneuvers by incorporating an emergency release that automatically activates on demand. A significant aspect of the present invention in the HEL application involves maintaining complete fall protection for the load before, during, and after the transfer process without impairing the availability of emergency flight maneuvers for the helicopter as is the case with prior art methods. It should be noted that, with use of the fall protection lanyard disclosed herein, the load is protected from an accidental fall during all phases of the transfer. Specifically, fall protection may be initially provided by an FAA safety restraint (e.g. seat belt or equivalent cargo restraint). During the next step in the process wherein the first lanyard 12 is attached to the aircraft, fall protection is provided by secured attachment of the lanyard segment 12 to a load bearing point on the helicopter; after which the FAA restraint may be removed. During the next step in the process, wherein the second lanyard segment 14 is connected to the adjacent structure, fall protection is provided by the second lanyard segment. It should be noted, that during this phase of the transfer, e.g. when the first lanyard segment is attached to the helicopter and the second lanyard segment is attached to the structure, the helicopter is effectively tethered to the structure, and the load is tethered to both the helicopter and the structure. If an actual or perceived emergency dictates that the helicopter pilot execute an emergency pull-away maneuver, the lanyard apparatus is placed in tension. When the predetermined force is reached, the limited slip mechanism 50 (or one of the alternate embodiments, e.g. break-away link 60) activates thereby deploying an additional length of lanyard, which change in length activates the quick-release mechanism of lanyard segment 12 thereby releasing hook 18 and allowing the helicopter to depart while lanyard 14 functions to secure the load to the structure. In the absence of an emergency, hook 18 is detached from the helicopter and the load is secured to the structure by lanyard 14. It should be noted that the limited slip mechanism (50 or 60), or an alternate means for activating release 30, may in an alternate embodiment, be incorporated on lanyard segment 12, and particularly on segment 12B, rather than on lanyard segment 14.

Furthermore, the present invention may be used in a variety of applications that require the safe transfer of a load from one elevated point to another while providing fall protection.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A safety apparatus for providing fall protection for a load in an elevated environment, said safety apparatus comprising:

a load bearing lanyard assembly, including first and second lanyards, each lanyard terminating in an end portion, said first lanyard end portion adapted to be secured to a first load supporting structure, said second lanyard end portion adapted to be secured to a second load supporting structure;

means for connecting said lanyard assembly to an external load;

said first lanyard including means for disconnecting said end portion thereof upon activation thereof; and means for activating said means for disconnecting said first lanyard end portion in response to a tensional force exceeding a predetermed threshold value between said first and second lanyard ends.

2. A safety apparatus for providing fall protection for a load in an elevated environment according to claim 1, wherein said means for releasing said first lanyard end portion comprises a releasable mechanical connection joining said first lanyard end portion to a remainder of said first lanyard.

3. A safety apparatus for providing fall protection for a load connected thereto in an elevated environment according to claim 1, wherein said means for activating includes a mechanical connection having a frangible link, said frangible link designed to fail when a tension force of a predetermined threshold value is applied to said first and second lanyard free ends, whereby failure of said frangible link activates said means for disconnecting thereby releasing the end portion of said first lanyard.

4. A safety apparatus for providing fall protection for a load connected thereto in an elevated environment according to claim 1, wherein said means for activating said releasable mechanical connection includes a frangible link.

5. A safety apparatus for providing fall protection for a load connected thereto in an elevated environment according to claim 4, wherein said frangible link comprises a rivet.

6. A safety apparatus for providing fall protection for human and non-human external loads in an elevated environment, said safety apparatus comprising:

a lanyard assembly including first and second connected lanyard segments, said first lanyard segement terminating in a first free-end portion, said second lanyard segemnt terminating in a second free-end portion;

means, disposed between said first and second free-end portions, for connecting said lanyard assembly to an external load;

said first free-end portion including means for connecting to a first-load supporting structure;

said second and free-end portion including means for connecting to a second load supporting structrure;

said first lanyard segment including means for releasing said free-end thereof upon activation; and means for activating said means for releasing said first lanyard free-end portion in response to a tensional force exceeding a predetermined threshold value applied to said first and second lanyard free-ends.

7. A safety apparatus for providing fall protection for human abd non-human loads in a elevated environment according to claim 6, wherein said means for releasing said first lanyard free-end portion comprises a releasable mechanical connection releasably joining said first lanyard free-end portion to said first lanyard segment.

8. A safety apparatus for providing fall protection for human and non-human loads in an elevated environment according to claim 7, wherein released mechanical connection comprises an interlocking three-ring mechanism activated by a slide-pin release mechanism.

9. A safety apparatus for providing fall protection for human and non-human loads in an elevated environment according to claim 6, wherein said means for activating said release means being responsive to an applied predetermined force applied to said lanyard free-ends includes a frangible link, whereby said frangible link is configured to activated said means for releasing in response to a force, greater than or equal to a predetermined threshold force, applied thereto.

* * * * *